United States Patent [19]

Harker et al.

[11] 4,162,862

[45] Jul. 31, 1979

[54] PAVEMENT STRIPING APPARATUS AND METHOD

[76] Inventors: James S. Harker, 5232 Hickory Pl.; Earl J. Harris, 1411 Morrie Ave.; Edward L. Haak, 5020 Greybull Ave., all of Cheyenne, Wyo. 82001

[21] Appl. No.: 894,440

[22] Filed: Apr. 7, 1978

[51] Int. Cl.[2] ..... E01C 23/16

[52] U.S. Cl. ..... 404/72; 404/122; 427/139; 427/137

[58] Field of Search ..... 404/122, 128, 93, 94, 404/72; 427/136, 137, 138, 139; 156/71, 577, 575; 118/108

[56] References Cited

U.S. PATENT DOCUMENTS

| | | | |
|---|---|---|---|
| 1,895,045 | 1/1933 | Moore | 404/72 |
| 2,192,290 | 3/1940 | O'Neal | 156/71 X |
| 2,534,507 | 12/1950 | Essick | 404/122 |
| 2,898,825 | 8/1959 | Walker | 404/12 |
| 3,060,077 | 10/1962 | Kauer | 404/122 X |
| 3,459,108 | 8/1969 | Patterson | 404/122 X |
| 3,832,079 | 8/1974 | Moorhead | 404/124 X |
| 3,844,669 | 10/1974 | Eigenmann | 404/94 |
| 4,071,384 | 1/1978 | Eigenmann | 404/94 X |

*Primary Examiner*—Nile C. Byers, Jr.
*Attorney, Agent, or Firm*—B. P. Fishburne, Jr.

[57] ABSTRACT

Pavement striping tape is drawn through a guide mounted on a rolling machine by the direct action of the front pavement roller. The tape is delivered from a spool or spools on a first spindle mounted above the tape guide and the tape backing paper is automatically withdrawn from the tape and wound up on a spool or spools on a second spindle spaced from and rotationally powered from the first spindle. Both spindles are driven by the movement of the tape downwardly due to the direct action of the front pavement roller. The striping tape is pressed by the roller into hot fresh asphalt paving material during the final rolling of the asphalt.

9 Claims, 4 Drawing Figures

FIG. 1
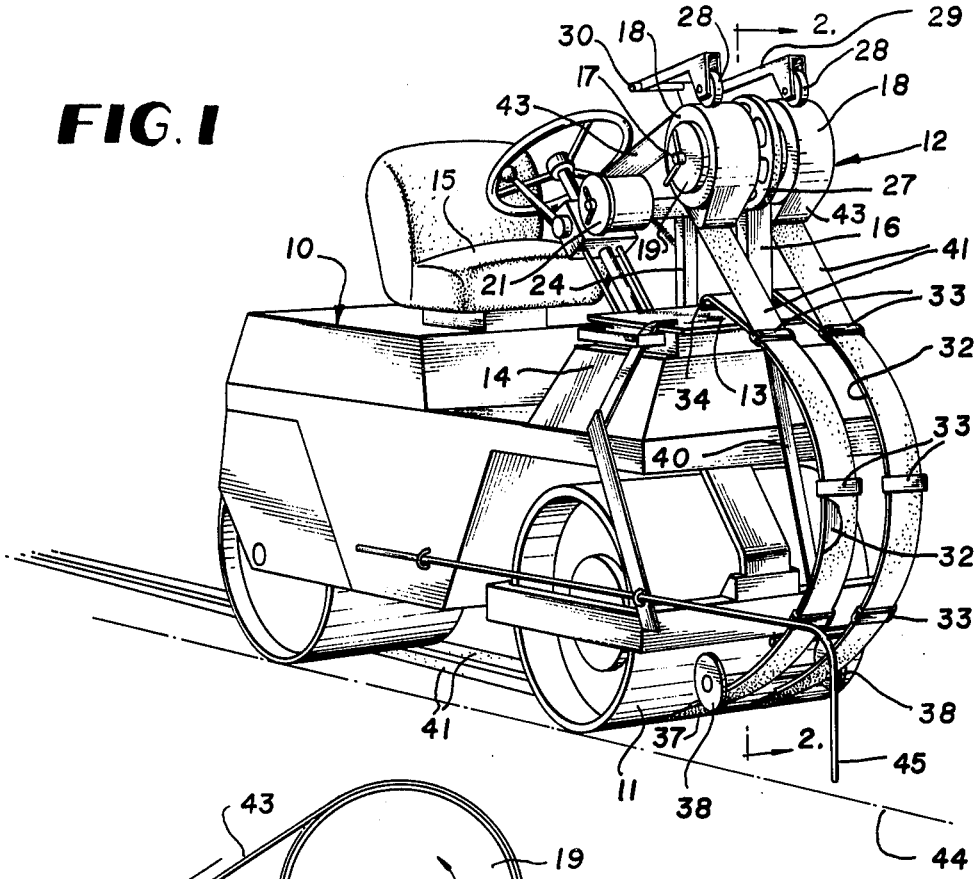
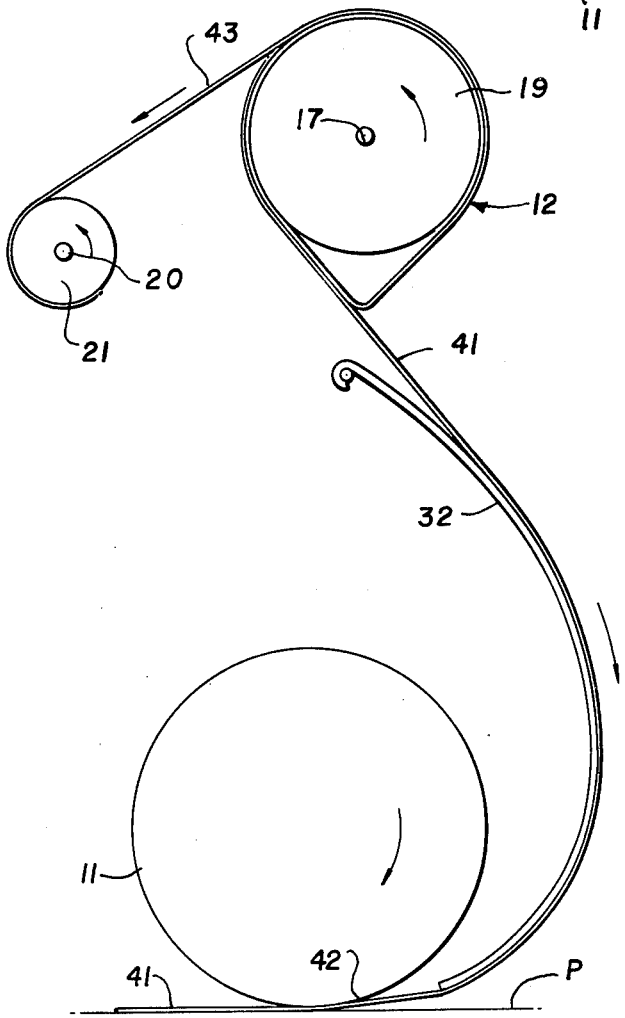
FIG. 4

PAVEMENT STRIPING APPARATUS AND METHOD

BACKGROUND OF THE INVENTION

The ever-increasing complexities of automotive traffic require wider use of roadway striping to direct traffic in required patterns. Some traffic striping, such as interstate highway lane marking, is done most economically by spray painting. However, this technique is not practical for many other pavement striping applications in urban areas and particularly where a longer-lasting and more durable stripe is desired. As a consequence of this, a second technique has evolved which consists of utilizing paper or plastic tape to stripe pavement in the necessary patterns for traffic guidance. The present invention constitutes an improvement over the prior art in this second category or technique utilizing tape. Briefly, the invention seeks to provide a method and an apparatus for applying striping tape directly onto fresh hot asphalt pavement during the final rolling of such pavement. In the invention, the action of the pavement roller is directly employed to pull marking tape or tapes through a guide means forming an attachment to the rolling machine. The tape or tapes are withdrawn automatically from a supply roll or rolls of the attachment and the customary tape backing paper is automatically stripped from the tape and wound up and stored on a second spindle spaced from and driven by the spindle carrying the tape roll or rolls. The striping tape, tape supply rolls and the backing paper winding spindle are all driven directly by the pavement roller without requiring any separate drive motor or other power means. The method and apparatus are characterized by extreme simplicity and economy and thus constitute a great improvement over the more complex and costly prior art.

Customarily, in the prior art, special machines separate from the basic pavement rolling machine are utilized to apply striping tape to already-completed pavement. Frequently, such machines include other attachments, such as pavement heaters and roughing brushes to prepare the pavement surface to accept the tape. The great advantage and economy of the present invention is its ability to apply the striping tape to the fresh hot paving material during the rolling thereof and utilizing the rolling machine to install the tape and power the tape dispensing attachment all during one simple operation, thus dispensing entirely with the need for a second separate machine for installing the tape.

To comply with the duty to disclose known prior art under 37 C.F.R. 1.56, the following prior United States patents are made of record herein: U.S. Pat. Nos. 1,895,045; 2,898,825; 3,404,057; 3,415,706; 3,844,669 and 4,030,958.

Various additional features and advantages of the invention will become apparent to those skilled in the art during the course of the following description.

BRIEF DESCRIPTION OF THE DRAWINGS

FIG. 1 is a perspective view of a pavement rolling machine equipped with the invention as an attachment thereto.

FIG. 4 is a schematic side elevation showing the power path through the apparatus under activation from the pavement roller.

DETAILED DESCRIPTION

Figure 3:
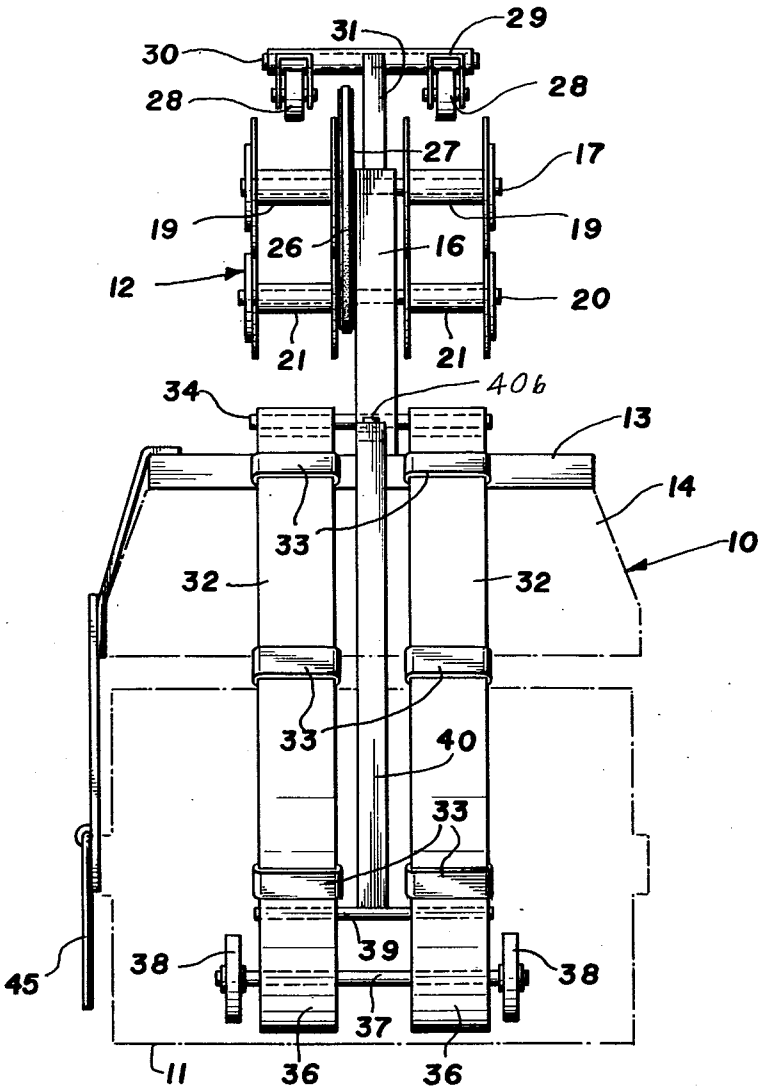
FIG. 3 is a front elevation of the apparatus.

Referring to the drawings in detail wherein like numerals designate like parts, a generally conventional pavement rolling machine 10 is shown in FIG. 1 including a front steerable pavement roller 11 whose rolling action is employed in the invention to drive a tape dispensing apparatus indicated in its entirety by the numeral 12 and mounted as an attachment on the rolling machine 10.

The apparatus 12 comprises a horizontal base 13 secured fixedly atop the forward portion 14 of the rolling machine frame ahead of the driver's seat 15 and directly above the forward pavement roller 11. A vertical standard 16 rises from the base 13 and supports a forward transverse horizontal spindle 17 at an elevation well above the base 13. The spindle 17, in the illustrated embodiment, supports a side-by-side pair of horizontal axis paving striping tape rolls 18, such rolls containing either paper or plastic striping tape of a well-known kind used for marking pavement. The tape rolls 18 are preferably mounted on spools 19, FIG. 3, carried by the first spindle 17.

Figure 2:
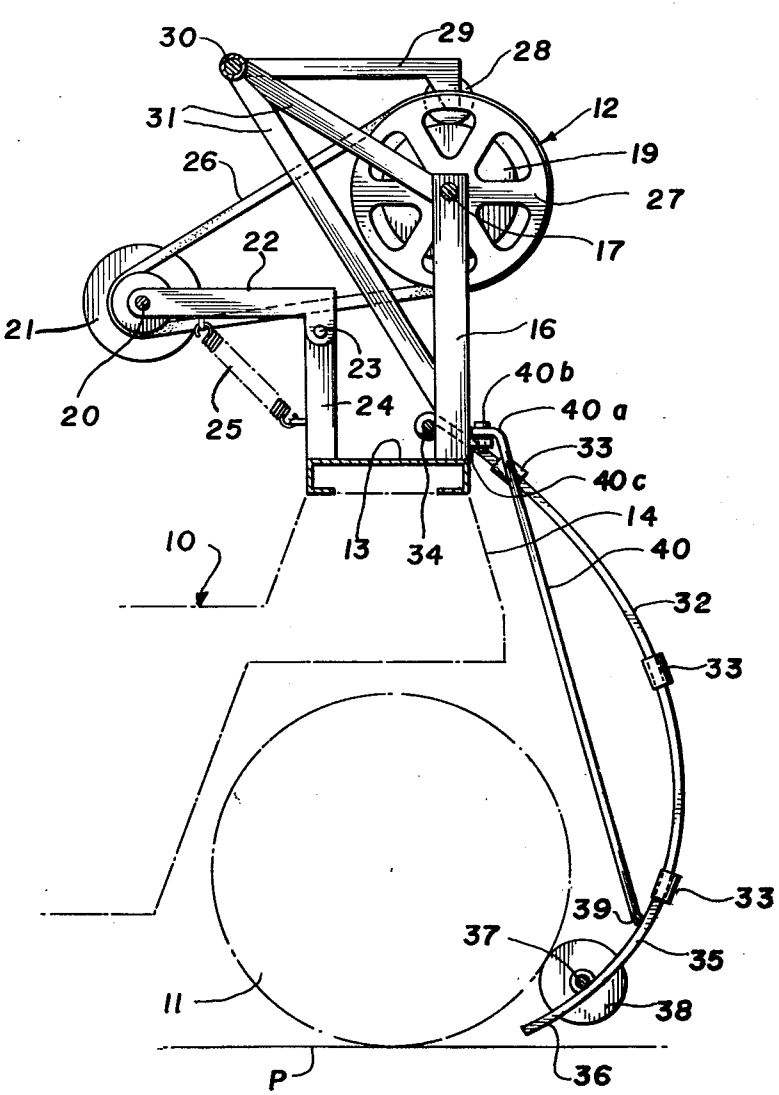
FIG. 2 is a side elevation of the apparatus embodied in the invention, partly in cross section, and shown in relationship to a rolling machine depicted in broken lines.

Rearwardly of and somewhat below the first spindle 17 is a second horizontal transverse spindle 20 carrying spools 21. The second spindle 20 is supported on a generally horizontal arm 22 pivoted at its forward end as at 23, FIG. 2, to a standard 24 rising from the base 13 behind the standard 16. The support arm 22 is urged downwardly on its pivot by a retractile spring 25 which serves as a belt tightener. The second spindle and its spools 21 are driven by a transmission belt 26 engaging a relatively large pulley 27 on the first spindle 17.

A pair of overhead comparatively small rollers 28 ride on top of the tape supply rolls 18 to stabilize them and these small rollers 28 are carried by a substantially horizontal yoke 29 having its rearward end pivoted at 30 to an extension frame 31 rising from and rigid with the standard 16. The rollers 28 remain in contact with the tape rolls 18 by gravity. The transmission belt 26 is maintained taut at all times by the spring 25.

The apparatus 12 additionally comprises, as an important feature thereof, a pair of laterally spaced parallel tape guides or slides 32 having identical side profiles and being provided near their opposite ends and midpoints by tape guide loops 33 rigid therewith. As viewed in profile, FIG. 2, the slides 32 have a smooth substantially constant curvature from their tops to lower end regions 35 where they are inclined somewhat more abruptly to terminate at 36 near and above pavement level and slightly forwardly of pavement roller 11. The slides 32 are formed of continuous uniform width and uniform thickness metal strips which are quite rigid but possess some springiness. The upper ends of the slides 32 are preferably hinged to a cross bar 34 which may be welded to the back of standard 16. The inclined portions 35 of the slides have a horizontal cross shaft 37 welded thereto carrying a pair of rotatable guide wheels 38 disposed immediately outwardly of the two slides, FIG. 3. These wheels 38 ride on the periphery of the pavement roller 11 to maintain an even spacing between the slide terminals 36 and pavement roller 11. The rollers 38 are required to stabilize the tape slides 32 which are cantilevered below the base 13 a substantial distance.

Another horizontal rod 39 is welded to the backs of tape slides 32 near and above the wheels 38 and a single brace bar 40 between the tape slides has its lower end welded to the cross rod 39. A short top extension 40*a* on brace bar 40 is slot pinned through a pin 40*b* to a lug 40*c* on the standard 16, FIG. 2. The brace bar 40 further stabilizes the two rather critical tape slides 32 but the springiness in the slides and the top slot pinned connection of the brace bar 40 allows for some limited movement or self-adjustment of the slides to prevent tearing of the striping tape.

The operation of the apparatus during the practice of the method is as follows. The pavement marking or striping tape rolls 18 are mounted on the spools 19 of spindle 17 as shown in the drawings. The plastic or paper striping tapes 41 are initially threaded by hand through the guide loops 33 and over the forward faces of the profiled slides 32 until the leading ends of the tapes can be introduced to the nip 42, FIG. 4, between the pavement roller 11 and the pavement P. The customary paper backing 43 on the tapes 41 is initially threaded by hand onto the spools 21 of the second spindle 20 behind the spindle 17.

Following this initial preparation, the rolling machine 10 is driven forwardly in the usual manner to produce the final rolling of the paving material, such as fresh hot asphalt, and in so doing, the striping tape 41 is automatically fed downwardly along the slides 32, as shown by the arrow in FIG. 4, and is pressed by the pavement roller 11 on and into the paving material in one smooth continuous operation for the necessary length of pavement to be striped or marked with tape.

The unique feature of the method is that the movement of the roller 11 during the normal final rolling of the pavement feeds or pulls the tapes 14 downwardly along the slides 32 and thus unwinds them from their supply rolls 11 causing rotation of the spools 19 and the spindle 17, together with the pulley 27 in the direction of the arrow shown in FIG. 4. This rotational movement of the spools 19 and pulley 27 transmits through the belt 26 rotation in the same direction to the spools 21 of rear spindle 20 to automatically wind up the backing paper strips 43 which are continuously peeled or stripped from the tapes 41 during the process in a continuous and smooth operation. The winding up or collecting of the backing paper 43 eliminates cluttering the premises with discarded material and makes for a clean and efficient operation.

The apparatus and process can dispense striping tape from one or two supply rolls in either four inch or six inch widths with lateral spacing between the tapes from zero inches up to four inches, as required.

While the invention is intended for use particularly with fresh hot asphalt, by the addition of a pavement heater, a rotary broom and possibly a small cutter head, all types of existing pavement surfaces can be processed to accept the striping tape applied in accordance with the method. Normally, the tape supply rolls 18 contain at least 150 feet of the striping tape, but the sizes of the rolls may vary. Typically the invention can be installed as an attachment to a five ton pavement roller but is not restricted to such a roller.

As previously noted, the invention, in addition to its extreme simplicity, dispenses with the need for two separate machines or a machine caravan for rolling the asphalt pavement and applying striping or marking tape thereto.

During the application of the striping tape, the rolling machine 10 follows a suitable straight guide line 44, FIG. 1, and to assist the driver in following such a straight line, a guidance rod 45 may be attached to one side of the machine as shown in the drawings in a position to be observed by the driver.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. An apparatus for rolling paving material and for striping the surface of the material in a combined operation comprising a pavement roller, a striping tape supply on the roller moving therewith, a tape guide means on the roller extending between the tape supply and a point near the nip between the roller and paving material being rolled, whereby said roller can press striping tape into the paving material during the rolling thereof and the roller can draw the tape from the supply and along the guide means to said nip.

2. An apparatus as defined in claim 1, and means on the pavement roller for winding up backing material as the material is stripped from the striping tape during the feeding of the tape to said nip.

3. An apparatus as defined in claim 2, and said tape supply comprising a tape roll and a first spindle means supporting said tape roll, and said means for winding up said backing material comprising a second spindle means spaced from and parallel to said first spindle means, and means drivingly interconnecting the first and second spindle means whereby they are turned in unison by the movement of the pavement roller and without the necessity for a separate power drive.

4. An apparatus as defined in claim 1, and said striping tape supply comprising a pair of striping tape rolls and horizontal axis spindle support means for said rolls on the pavement roller, said tape guide means comprising a pair of profiled plates disposed in laterally spaced parallel relationship and fixed to the pavement roller and having lower ends terminating near and forwardly of said nip.

5. An apparatus as defined in claim 4, and plural longitudinally spaced tape guides on said profiled plates, said plates being disposed somewhat forwardly of the front roller of said pavement roller and being generally vertical and somewhat arcuate.

6. An apparatus as defined in claim 5, and said plates having lower end inclined portions projecting beneath said front roller and close to said nip, and guide wheels on said inclined portions rollingly contacting said front roller.

7. The method of claim 1, and utilizing the rolling movement of said rolling means on said paving material to pull striping tape from a supply roll of tape and feed it to the point of engagement of the rolling means with the paving material.

8. A method of applying striping tape to fresh hot asphaltic pavement during the finish rolling of the pavement in a single combined operation, comprising the steps of rolling fresh hot asphaltic paving material to produce a finished wear surface thereon, simultaneously utilizing the rolling movement of a pavement roller to continually pull pavement striping tape from a tape source, and positively guiding said striping tape during its movement from said source so that the tape is continually delivered onto the pavement immediately in advance of said roller and substantially at the nip defined between the roller and pavement.

9. The method as defined in claim 8, and the additional step of stripping backing material from said tape and collecting the backing material during the pulling of the tape from said tape source by the rolling movement of said roller.

* * * * *